US006260332B1

(12) United States Patent
Takayanagi

(10) Patent No.: US 6,260,332 B1
(45) Date of Patent: Jul. 17, 2001

(54) APPARATUS FOR AND METHOD OF MANUFACTURING SOFT CAPSULES

(75) Inventor: Tetsuo Takayanagi, Tokyo (JP)

(73) Assignee: Kabushiki Kaisha Kamata, Tokyo (JP)

( * ) Notice: Subject to any disclaimer, the term of this patent is extended or adjusted under 35 U.S.C. 154(b) by 0 days.

(21) Appl. No.: 09/246,236

(22) Filed: Feb. 8, 1999

(30) Foreign Application Priority Data

Feb. 9, 1998 (JP) ..... 10-042910

(51) Int. Cl.[7] ..... B65B 47/00
(52) U.S. Cl. ..... 53/454; 53/560; 53/900
(58) Field of Search ..... 53/454, 453, 560, 53/559, 900; 425/348, 362, 345

(56) References Cited

U.S. PATENT DOCUMENTS

| | | | | |
|---|---|---|---|---|
| 1,970,396 | * | 8/1934 | Scherer | 53/454 X |
| 2,334,600 | * | 11/1943 | Boysen | 53/454 X |
| 3,579,960 | * | 5/1971 | Mehta | 53/560 |
| 4,279,278 | * | 7/1981 | Weresch . | |
| 4,567,714 | * | 2/1986 | Chasman | 53/454 X |
| 4,571,924 | * | 2/1986 | Bahrani | 53/560 |
| 4,614,076 | * | 9/1986 | Rathemacher | 53/560 |
| 4,750,318 | * | 6/1988 | Matsuzawa | 53/560 |

* cited by examiner

*Primary Examiner*—Eugene Kim
(74) *Attorney, Agent, or Firm*—Flynn, Thiel, Boutell & Tanis, P.C.

(57) ABSTRACT

An apparatus for and a method of manufacturing soft capsules wherein a filling material such as liquid medicine is encapsulated by two pieces of gelatin sheet are provided. The soft capsule manufacturing apparatus comprises a pair of die rolls that are close to and confront each other, each die role having capsule pockets in a plurality of rows, and a nozzle segment having an inverse mountain-like projection for supplying a filling material, wherein the inverse mountain-like projection has curved faces that are positioned in confronting relation with each other at right and left sides about the lower end central portion thereof, have nozzle holes, wherein the inverse mountain-like projection confronts a curved recess that is surrounded by curved peripheral surfaces of the die rolls at the upper sides thereof, and wherein two gelatin sheets are supplied between the die rolls from the upper portion thereof to receive the filling material therein corresponding to the capsule pockets of each die roll to manufacture soft capsules, and wherein the nozzle holes are arranged on the curved faces in a plurality of rows corresponding to the capsule pockets provided on the die rolls in a plurality of rows. With this arrangement, when the pump is actuated one time, the filling material is supplied at a time from the nozzle holes arranged in a plurality of rows to the capsule pockets arranged in a plurality of rows, leading to remarkable increase of the production of the capsule pockets.

5 Claims, 8 Drawing Sheets

APPARATUS FOR AND METHOD OF MANUFACTURING SOFT CAPSULES

BACKGROUND OF THE INVENTION

1. Field of the Invention

The invention relates to an apparatus for and a method of manufacturing soft capsules wherein a filing material such as liquid medicine is encapsulated by two pieces of gelatin sheet.

2. Description of Related Art

Soft capsules are generally manufactured by a manufacturing apparatus as illustrated in FIG. 7.

The manufacturing apparatus includes a pair of die rolls 10, 10 that are close to and confront each other, a nozzle segment 20 that supplies a filling material and is formed of an inverse mountain-like projection 21 having curved faces that are positioned in confronting relation with each other at right and left sides about the lower end central portion thereof, wherein the projection 21 confront and is engaged in a curved recess S1 that is formed by surrounding curved peripheral surfaces of the die rolls 10, 10 at the upper sides thereof, and a supply hopper 30 located at the uppermost end thereof.

There are a distributor (dispersion plate) 41 for distributing the filling material, a slide valve mechanism 42 for controlling the supply of the filling material by sliding operation, a tube assembly plate 43 on which pipes for connection with a plurality of tubes are provided upright, and a plunger type pump 50 (hereinafter referred to simply as a pump 50) having a plurality of cylinders, that are respectively interposed between the nozzle segment 20 and the supply hopper 30 in the ascending order, and wherein the plurality of tubes (hoses) 61 for supplying the filling material threrethrough that are provided between the plurality of cylinders of the pump 50 and the tube assembly plate 43. Further, there are provided a return tube (hose) 62 that is interposed between the distributor 41, the slide valve mechanism 42 and the supply hopper 30, for returning the filling material that becomes useless, strip rolls 71, 71 for separating a pair of soft capsules that are provided under and appropriately away from the die rolls 10, 10, and a pair of mangle rolls 72, 72 which draws the pair of gelatin sheets.

When manufacturing the soft capsules, two gelatin sheets 100, 100 are supplied between the pair of rotating die rolls 10, 10 from the upper side thereof at the right and left sides thereof, and the filling material such as liquid medicine is filled in the supply hopper 30, wherein the filling material is supplied to a plurality of nozzle holes 22 that are arranged in one row in a longitudinal direction of the right and left curved faces of the inverse mountain-like projection 21 of the nozzle segment 20 at portions close to the lower end edge (or at the lowermost end edge) through the tubes 61, the tube assembly plate 43, the slide valve mechanism 42 and the distributor 41 when the pump 50 is actuated.

As a result, a plurality of capsule pockets 11 that are provided on the outer peripheral surfaces of the die rolls 10, 10 and arranged axially in a row occupy the nozzle holes 22 of the nozzle segment 20 while they are rotated, and hence the filling material is temporarily stored inside two gelatin sheets 100, 100, and they are conveyed downward with the rotation of the die rolls 10, 10. The gelatin sheets 100, 100 are brought into intimate contact with each other in a moment when the filling material passed through the narrowest part between the die rolls 10, 10, and they are cut and brought into intimate contact with each other under pressure at the same time when the annular blades that are formed at the peripheries of the capsule pockets 11 of the die rolls 10, 10 mesh with each other, so that intended soft capsules 200 are formed.

The thus formed soft capsules 200 that remain stuck to the capsule pockets 11 of the die rolls 10, 10 are stripped off by a brush or the like while the soft capsules 200 that remain stuck to a remaining gelatin sheet 101 formed by bonding two gelatin sheets 100, 100 are separated by the pair of strip rolls 71, 71, and also the remaining gelatin sheet 101 is drawn downward by the pair of mangle rolls 72, 72.

The soft capsules are instantaneously manufactured in practice, wherein the setting of the discharging accuracy of the filling material from the nozzle holes 22 of the nozzle segment 20 and of the timing such as rotation of the die rolls 10, 10 become very important If the discharging accuracy and the timing such as rotation are poorly set, the amount of the filling material filled in the soft capsules 200 is varied or the gelatin sheets 100, 100 are poorly bonded to each other or there occurs the deformation of the shape of the soft capsules 200.

Accordingly, there has been generally employed a pump as the pump 50 shown in FIG. 8, wherein the pump includes a plurality of cylinders 51*a*, 51*b* (respectively five cylinders in this example) that are arranged symmetrically at right and left. Either of the cylinders 51*a*, 51*b* corresponds to each nozzle hole 22 of the nozzle segment 20 so as to secure the discharging accuracy, and a timing between the actuating or driving speed of the pump 50 and the rotational speed of the die rolls 10, 10 is accurately provided or set using a timing gear or the like.

For example, a concrete filling state is explained with reference to a case using the pumpor plunger 50 shown in FIG. 8, the typical nozzle segment 20 having five nozzle holes 22*a* to 22*e* as shown in FIGS. 9 and 10, and a typical right die roll 10 (left die roll 10 is omitted in FIG. 10) having three capsule pockets 11*a*, 11*b* and 11*c* that are arranged along the row denoted by the line A—A and two capsule pockets 11*a* and 11*b* are arranged along the row denoted by the line B—B wherein these capsule pockets are repeatedly provided in the circumferential direction.

When the filing material is filled in the three capsule pockets 11*a*, 11*b* and 11*c* that are arranged in the row denoted by the line A—A, all the cylinders 51*b* provided at the right side of the pump 50 are actuated, while when the filling material is discharged, the nozzle holes 22*a*, 22*c* and 22*e* of the nozzle segment 20 corresponding to the capsule pockets 11*a*, 11*b* and 11*c* are used, whereas the filling material corresponding to the nozzle holes 22*b* and 22*d* is returned to the supply hopper 30 through the distributor 41, the slide valve mechanism 42 and the return tube 62.

Meanwhile, when the filling material is filled in the next two capsule pockets 11*a* and 11*b* that are arranged in the row denoted by the line B—B, all the cylinders 51*b* provided at the right side of the pump 50 are actuated, while when the filing material is discharged, the nozzle holes 22*b* and 22*d* of the nozzle segment 20 corresponding to the two capsule pockets 11*a* and 11*b* are used, whereas the filling material corresponding to the nozzle holes 22*a*, 22*c* and 22*e* are returned to the supply hopper 30 through the distributor 41, the slide valve mechanism 42 and the return tube 62. Such a filling operation is simultaneously operated at the left side of the die roll 10.

Such a discharging process is sequentially repeated by the rotation of the die rolls 10, 10 so as to form intended soft capsules 200.

However, there are following problems in the conventional apparatus for and a method of manufacturing soft capsules.

First, it is necessary to increase the rotational speed of each die roll 10 to increase the volume of production. However, the driving speed of the pump 50 interlocked with the die roll 10 should be increased to increase the rotational speed of the die roll 10. Since the pump 50 is a plunger type having many mechanical parts, it has a natural problem or limits in the speeding up thereof.

Particularly, since the capsule pockets 11 are formed and arranged at an equal interval in the circumferential direction of each die roll 10, the number of capsule pockets having less filling amount becomes more than the number of those having large filling amount in the circumferential direction, so that even if the rotational speed of the die roll 10 is low, the pump 50 is required to have a relatively high driving speed. Accordingly, the die roll 10 having many capsule pockets in the circumferential direction has a serious problem in that it is hardly possible to speed up the rotational speed thereof in view of the limits of performance of the pump 50.

Secondly, if the driving speed of the pump 50 increases, the filing accuracy is lowered, causing a problem of the deterioration of the soft capsules.

Thirdly, when the rotational speed of the die roll 10 and the driving speed of the pump 50 respectively increase, a mechanical load applied to the apparatus increases, causing a problem in that trouble is liable to occur so that the apparatus can not be used for a long period of time.

Fourthly, although it is possible to increase the number of capsule pockets in the axial direction using the die roll 10 having a long axis, it causes a problem in that the entire apparatus as well as the die roll per se has high costs.

Under the circumstances of having such various problems, the inventor of this application has endeavored himself in studying carefully to improve the productivity and has found out as follows. That is, for example, if there are provided nozzle holes in another row in addition to the nozzle holes 22 of one row of the projection 21 of the nozzle segment 20 that has been heretofore provided so that the projection 21 has nozzle holes in a plurality of rows, the filling material can be theoretically supplied at a time from the nozzle holes 22 arranged in a plurality of rows (two rows) of the nozzle segment 20 to the capsule pockets 11 arranged in a plurality of rows (two rows) of the die rolls 10, 10 when the pump 50 is actuated one time (one stroke), resulting in the increase of the rotational speed of the die roll 10.

Accordingly, the inventor experimentally manufactured the soft capsules by providing the nozzle holes 22 on the projection 21 of the nozzle segment 20 in a plurality of rows (two rows) and supplying the filling material at a time from the nozzle holes 22 in the plurality of rows of the nozzle segment 20 to the capsule pockets 11 arranged in the plurality of rows of the die rolls 10, 10 by driving the pump 50 one time (one stroke), resulting in the finding that there does not cause any problem if the driving speed of the pump 50, the rotational speed of the die roll 10, and the shapes of curved surfaces on which the nozzle holes 22 of the nozzle segment 20 are opened, are adjusted optimally.

SUMMARY OF THE INVENTION

The present invention has been made in view of the aforementioned problems and it is an object of the invention to provide an apparatus for and a method of manufacturing soft capsules capable of eventually doubling the rotational speed of the die roll by supplying a filling material at a time from the nozzle holes provided on the projection of a nozzle segment in two rows to capsule pockets provided on the die rolls in two rows when a plunger type pump is actuated one time (one stroke) even if the driving speed of the plunger type pump is slow.

To achieve the above object, the soft capsule manufacturing apparatus according to a first aspect of the invention comprises a pair of die rolls that are close to and confront each other; each die role having capsule pockets in a plurality of rows, and a nozzle segment having an inverse mountain-like projection for supplying a filling material, wherein the inverse mountain-like projection has curved faces that are positioned in confronting relation with each other at right and left sides about the lower end central portion thereof, and have nozzle holes, and wherein the inverse mountain-like projection confronts a curved recess that is surrounded by curved peripheral surfaces of the die rolls at the upper sides thereof, and wherein two gelatin sheets are supplied between the die rolls from the upper portion thereof to receive the filling material therein corresponding to the capsule pockets of the die rolls to manufacture soft capsules, characterized in that the nozzle holes are arranged on said curved faces in a plurality of rows corresponding to the capsule pockets provided on the die rolls in a plurality of rows.

The method of manufacturing soft capsules according to a second aspect of the invention in the apparatus of the first aspect of the invention comprising a pair of die rolls that are close to and confront each other; each die role having capsule pockets in a plurality of rows, and a nozzle segment having an inverse mountain-like projection for supplying a filling material, wherein the inverse mountain-like projection has curved faces that are positioned in confronting relation with each other at right and left sides about the lower end central portion thereof, and curved faces have nozzle holes, and wherein the inverse mountain-like projection confronts a curved recess that is surrounded by curved peripheral surfaces of the die rolls at the upper sides thereof, and wherein two gelatin sheets are supplied between the die rolls from the upper portion thereof to receive the filling material therein corresponding to the capsule pockets of the die rolls to manufacture soft capsules, characterized in that the method comprises arranging said nozzle holes on said curved faces of the nozzle segment in a plurality of rows corresponding to the capsule pockets provided on the die rolls in a plurality of rows, and supplying the filling material at a time from the nozzle holes in a plurality of rows corresponding to the capsule pockets provided on the die rolls in a plurality of rows.

PREFERRED EMBODIMENT OF THE INVENTION

An apparatus for and a method of manufacturing soft capsules according to the invention will be now described with reference to FIGS. 1 to 6.

Figure 1:
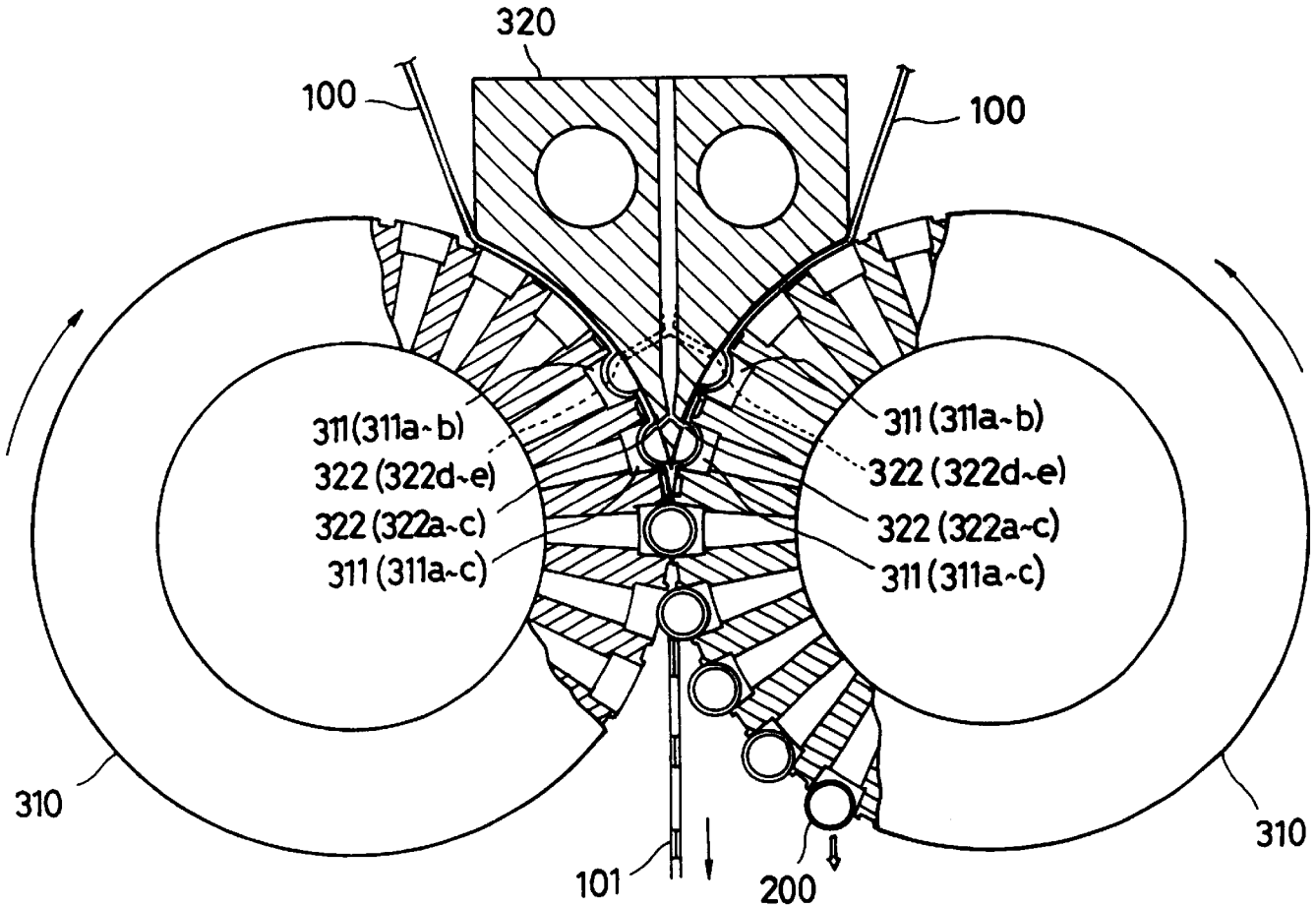
FIG. 1 is a longitudinal sectional view showing a state where a nozzle segment and a pair of die rolls are close to or grapple with one another in a soft capsule manufacturing apparatus according to an embodiment of the invention.
Figure 2:
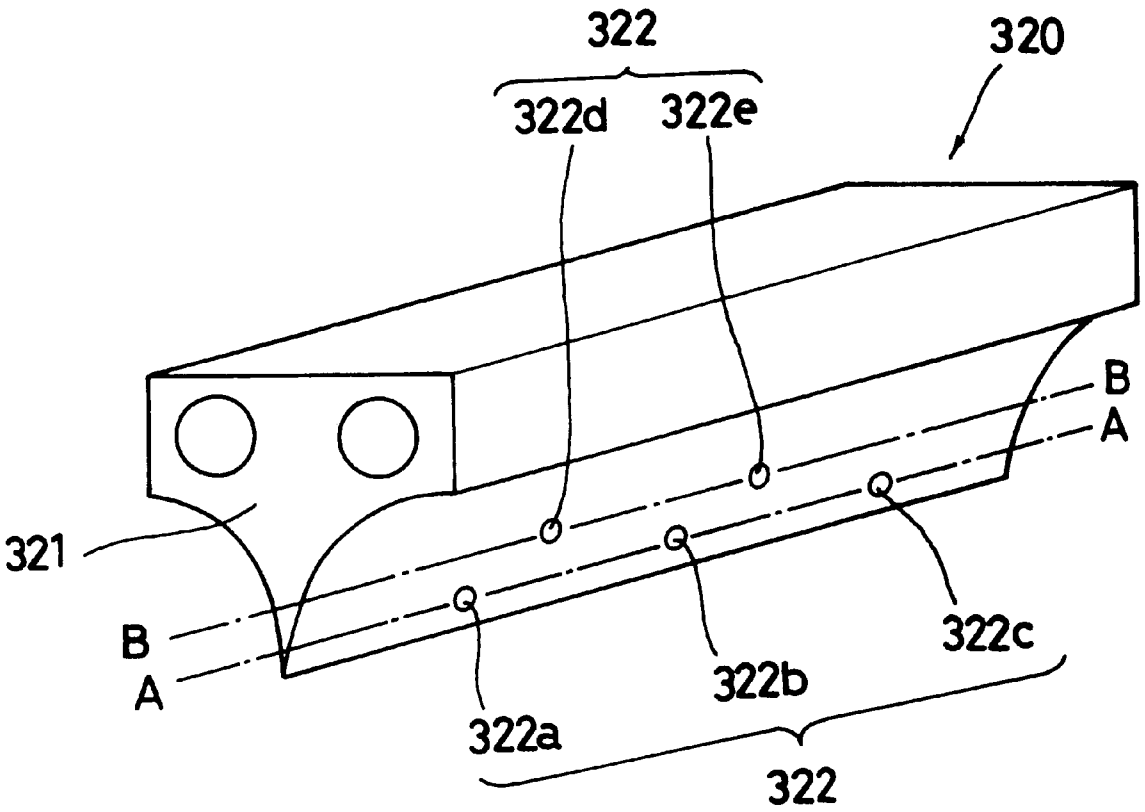
FIG. 2 is a perspective view showing the nozzle segment of the soft capsule manufacturing apparatus in FIG. 1.
Figure 3:
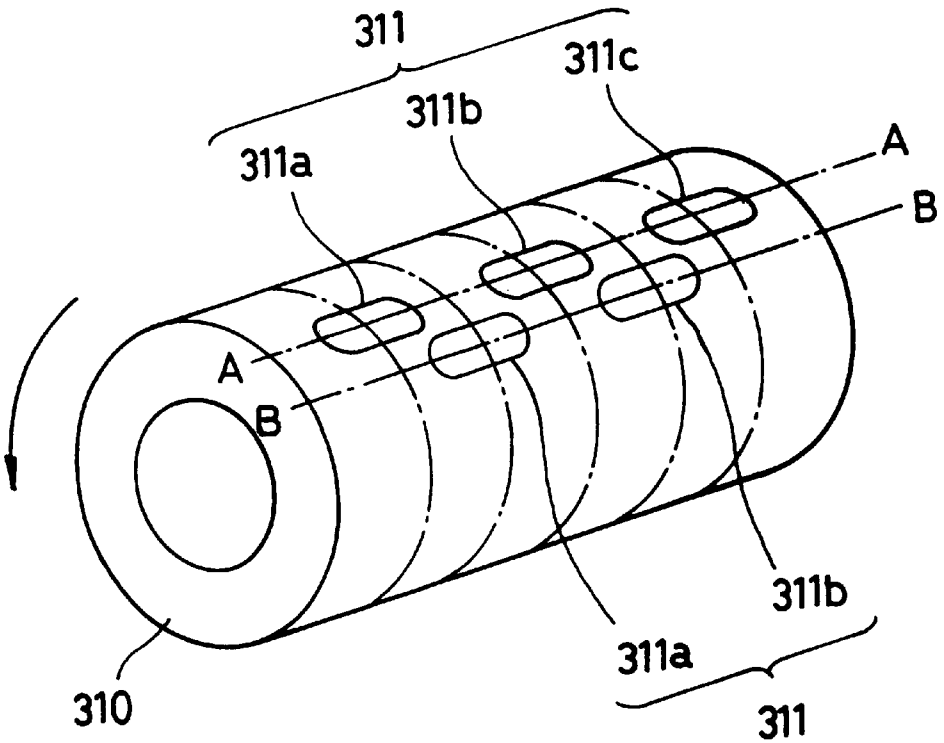
FIG. 3 is a perspective view of the die rolls employed by the soft capsule manufacturing apparatus in FIG. 1.

FIG. 1 shows an assembly of a nozzle segment 320 and a pair of die rolls 310, 310 of a soft capsule manufacturing apparatus according to the invention. The components other than those of the prior art described with reference to FIGS. 7 to 10 are substantially the same.

The nozzle segment 320 has a plurality of nozzle holes 322 provided at right and left curved surfaces thereof, positioned close to the lower end central portion of an inverse mountain-like projection 321 and arranged in a plurality of rows (two rows) in the longitudinal direction thereof. This is typically concretely shown in FIG. 2 wherein there are, for example, three nozzle holes 322*a*, 322*b* and 322*c* along the row denoted by the line A—A close to the lowermost end of the inverse mountain-like projection 321 while there are, for example, provided two nozzle holes 322*d* and 322*e* along the row denoted by the line B—B close to and slightly over the row denoted by the line A—A. These nozzle holes 322*a*, 322*b* and 322*c* and nozzle holes 322*d* and 322*e* are also provided at the opposite curved surface of the inverse mountain-like projection 321.

The three nozzle holes 322*a*, 322*b* and 322*c* correspond to three capsule pockets 311*a*, 311*b* and 311*c* provided on the right die roll 310 arranged along the row denoted by the line A—A while the two nozzle holes 322*d* and 322*e* correspond to two capsule pockets 311*a* and 311*b* provided on the right die roll 310 arranged along the row denoted by the line B—B. The relation between the capsule pockets and nozzle holes in the left die roll 310 is the same as that in the right die roll 310.

Accordingly, when the soft capsules are manufactured using the soft capsule manufacturing apparatus, for example, a plunger type pump 50 is actuated to drive all the right and left plurality of cylinders 51*a*, 51*b* (respectively five pieces) wherein three of five cylinders are driven to discharge the filling material through the nozzle holes 322*a*, 322*b* and 322*c* of the nozzle segment 320 to supply the filling material to the gelatin sheets 100, 100 corresponding to the capsule pockets 311*a*, 311*b* and 311*c* arranged along the row denoted by the line A—A of the die roll 310 while two of five cylinders are driven to discharge the filling material from the nozzle holes 322*d* and 322*e* of the nozzle segment 320 to supply the filling material to the gelatin sheets 100, 100 corresponding to two capsule pockets 311*a* and 311*b* arranged along the row denoted by the line B—B of the die roll 310.

Thereafter, when the two gelatin sheets 100, 100 are conveyed downward and passed through the narrowest portion between the die rolls 310, 310 during the rotation of the die rolls 310, 310, they are instantaneously brought into intimate contact with each other. At the same time, when the annular blades that are formed at the peripheries of the capsule pockets 311 of the die rolls 310, 310 mesh with each other, the gelatin sheets 100, 100 are cut and they are pressed against and bonded to each other to form soft capsules 200.

In this case, when the pump 50 is actuated one time (one stroke), the filling material is supplied at a time from the nozzle holes 322*a*, 322*b* and 322*c* and the nozzle holes 322*d* and 322*e* arranged in two rows of the curved surfaces of the inverse mountain-like projection 321 of the nozzle segment 320 to the capsule pockets 311*a*, 311*b* and 311*c* and the capsule pockets 311*a* and 311*b* arranged in two rows of the die roll 310. In other words, the rotational speed of each die roll 310 can be eventually doubled even if the driving speed of the pump 50 remains slow (even in the conventional speed), thereby realizing a large amount of production of the capsule pockets (double per hour).

Further, it is possible to achieve the remarkable increase of the production of the capsule pockets by merely providing the nozzle holes 322*a*, 322*b* and 322*c* and the nozzle holes 322*d* and 322*e* in two rows at the nozzle segment 320 while the standard such as the size of each die roll 310 and the size of nozzle segment 320 remains as it is, namely, even if each die roll 310 and the nozzle segment 320 employ the conventional standards. It is needless to say that the cylinder have a number corresponding to the number of capsule pockets provided on each die roll 310 in the rows denoted by the line A—A and the line B—B. The distributor 41 and the slide valve mechanism 42 may be easily exchanged with others, because these elements are inherently exchangeable parts.

Figure 4:
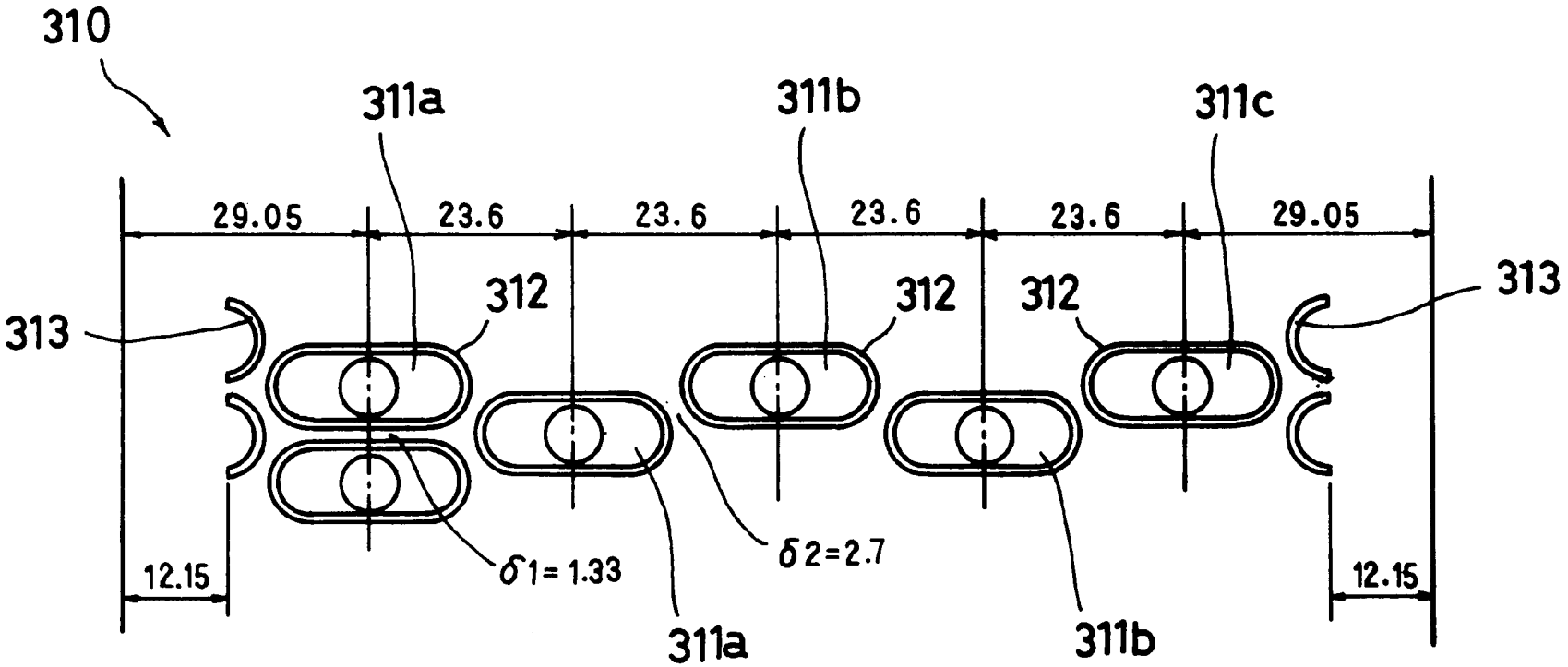
FIG. 4 is a partially plan view showing a standard of the die roll employed by the soft capsule manufacturing apparatus in FIG. 1.
Figure 5:
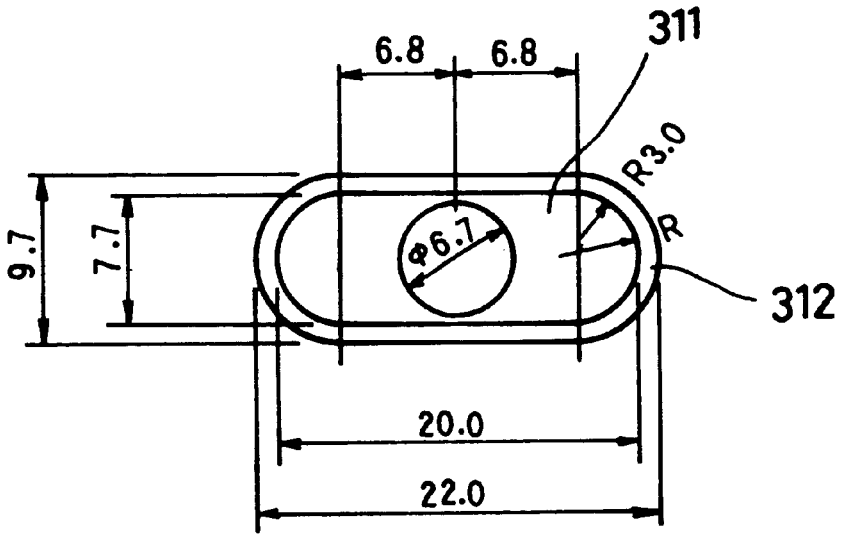
FIG. 5 is a partially plan view showing a standard of each capsule pocket of the die roll in FIG. 4.
Figure 6:
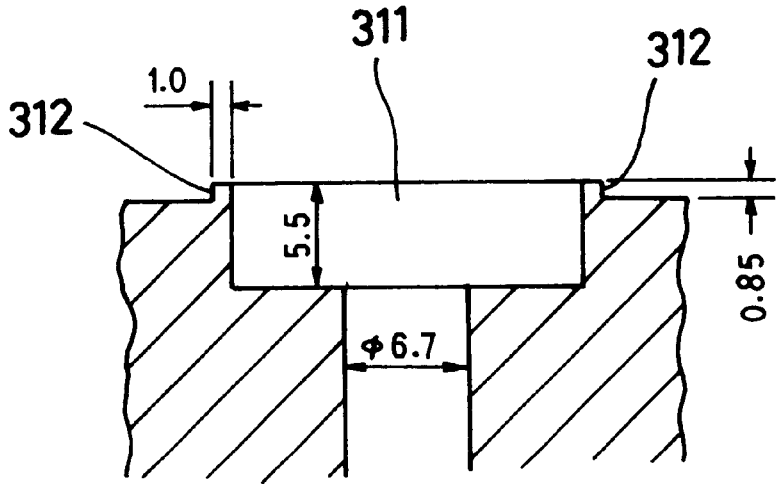
FIG. 6 is a partially sectional view showing another standard of capsule pockets of the die roll in FIG. 4.
Figure 7:
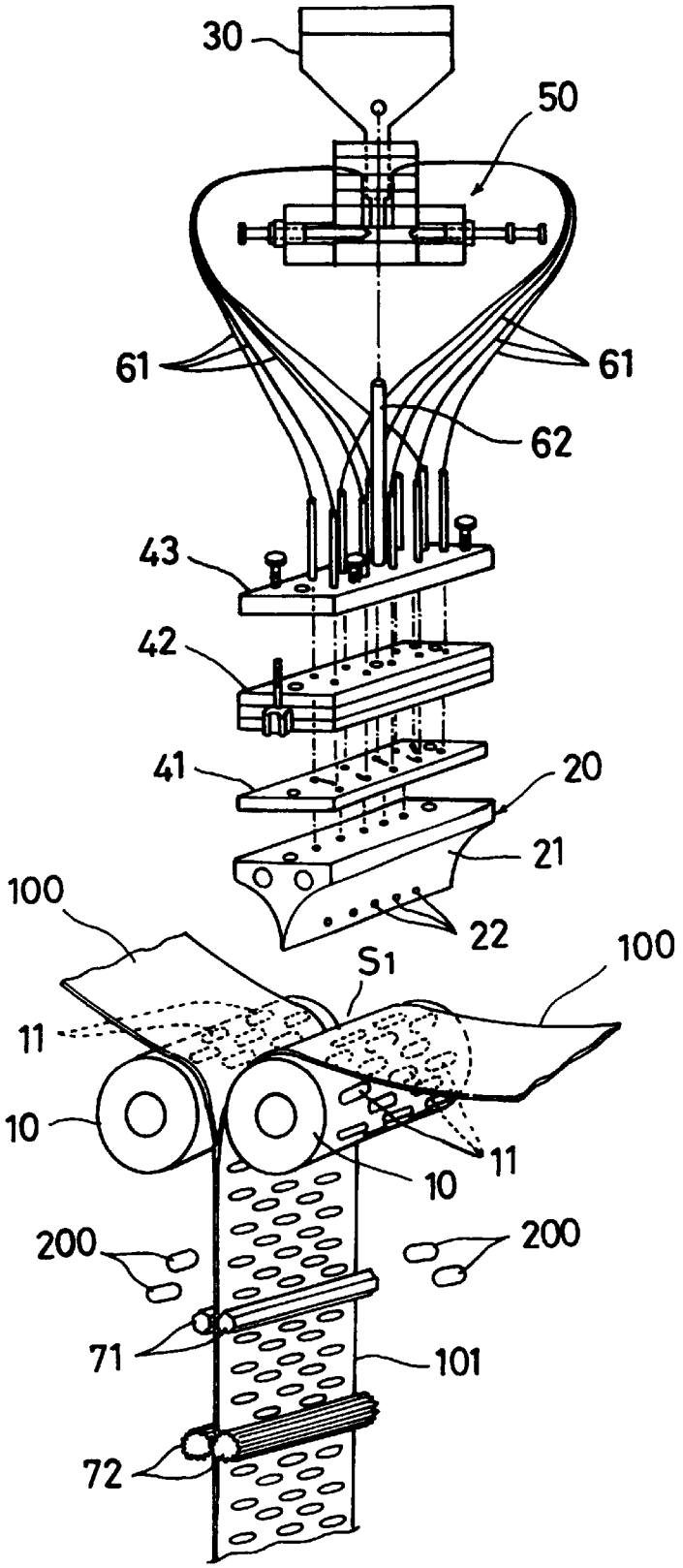
FIG. 7 (PRIOR ART)
FIG. 7 is an exploded view showing a diagrammatic construction of a main part of a soft capsule manufacturing apparatus that is used generally.
Figure 8:
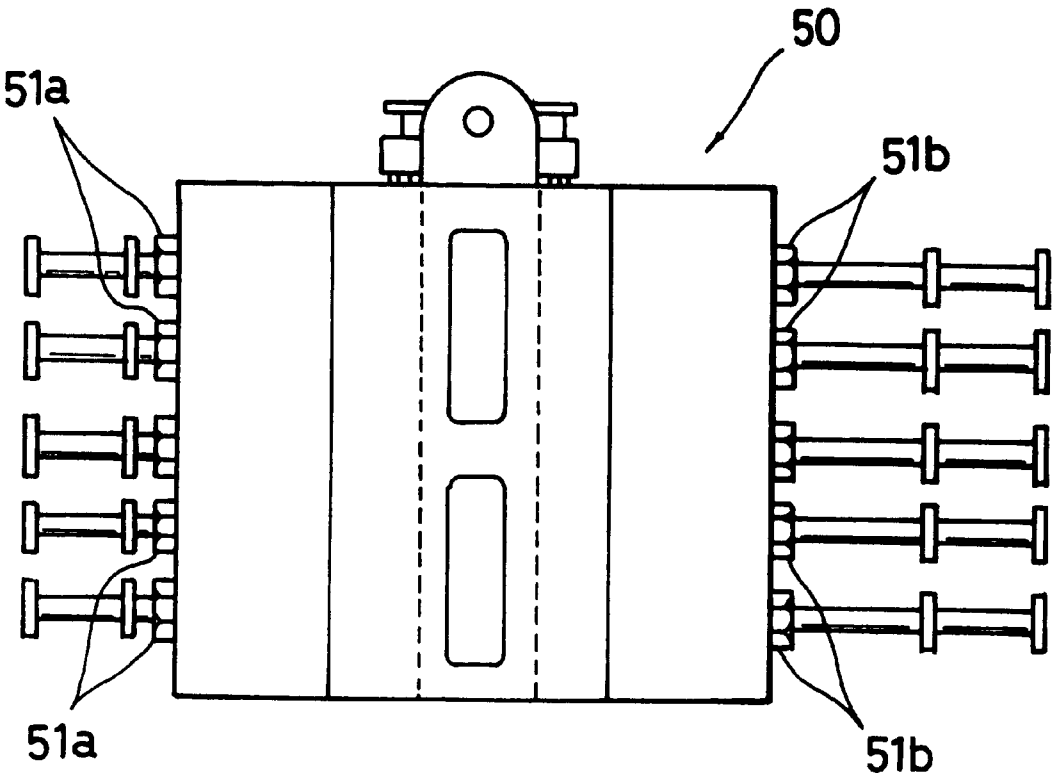
FIG. 8 (PRIOR ART)
FIG. 8 is a plan view showing a state where a supply hopper of a plunger type pump and a tube connecting part positioned under the supply hopper of the soft capsule manufacturing apparatus in FIG. 7 are removed.
Figure 9:
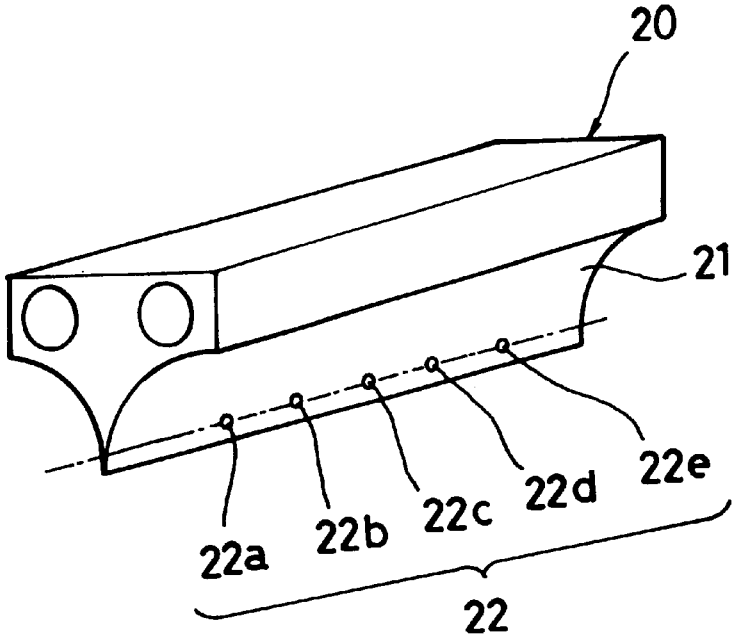
FIG. 9 (PRIOR ART)
FIG. 9 is a perspective view of a nozzle segment of the soft capsule manufacturing apparatus in FIG. 7.
Figure 10:
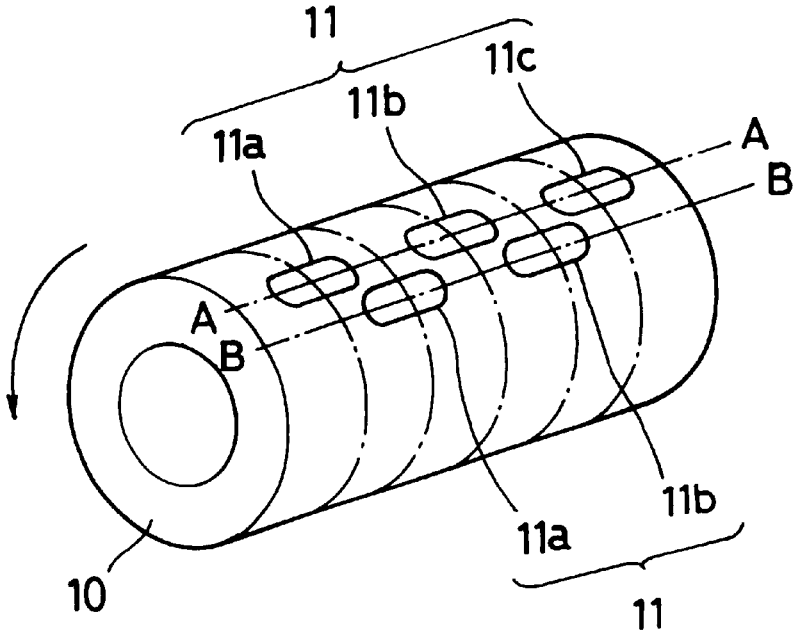
FIG. 10 (PRIOR ART)
FIG. 10 is a perspective view of a die roll of the soft capsule manufacturing apparatus in FIG. 7.

Particularly, although the die roll 310 can be used as it is, namely, the conventional die roll shown in FIG. 10 can be used, it is preferable that the interval between capsule pockets in each row (precisely, the interval between each blade in the circumferential direction) is small in view of the prevention of leakage of filling material because the filling material is supplied at a time to the capsule pockets provided at the die roll in two rows. The standard of the die roll 310 that is practically used is shown in FIGS. 4 to 6, wherein denoted by 312 are blades, 313 are projections for pressing the edges of the gelatin sheets. The diameter of each die roll is 102.8 mm and the length of the axis of each roll is 152.5 mm. The length of the axis of each roll is divided by 29. The number of capsule pockets (3 rows+2 rows=5 rows) becomes 145, the interval $\delta 1$ between the blades 312 and 312 in the circumferential direction becomes 1.33 mm, the interval $\delta 2$ between the blades 312 and 312 in the axial direction becomes 2.7 mm, the width of each blade becomes 1.0 mm, and the height of the each blade becomes 0.85 mm.

Although in the preferred embodiment set forth above, the filling material is supplied at a time from the nozzle holes provided at the projection 321 of the nozzle segment 320 arranged in two rows to the capsule pockets 311 provided on the die roll 310 in two rows, the invention is not limited to respective two rows but three or more rows may be theoretically provided.

As is evident from the foregoing, there are following effects according to the soft capsule manufacturing apparatus and the method of manufacturing the capsule pockets.

1. Since the nozzle holes are provided in two rows on the inverse mountain-like projection of the nozzle segment corresponding to capsule pockets provided in two rows on each die roll, it is possible to supply filling material at a time to the capsule pockets in two rows when the plunger type pump is actuated one time (one stroke). As a result, the rotational speed of each roll is eventually doubled even if the driving speed of the plunger type pump remains slow. Accordingly, the number of capsule pockets per hour becomes substantially doubled, thereby dramatically improving the amount of production of the capsule pockets.

2. Considering limits in the speeding up of the pump because of many mechanical parts thereof, there is an advantage that the invention can use such a pump since the driving speed of the plunger type pump remains slow.

Particularly, the advantage set forth above has solved the problem of the rotational speed of the die roll which has many capsule pockets in the circumferential direction and which has been difficult to be speeded up so far owing to the limits of the driving speed of the conventional plunger type pump.

3. Further, the fact that the driving speed of the plunger type pump remains slow contributes to the filling accuracy, thereby enhancing the quality of each capsule pocket.

4. Still further, the fact that the rotational speed of the die roll is doubled while the driving speed of the plunger type pump remains slow allows the margin to the setting between the driving speed of the pump and the rotational speed of the die roll (the driving speed of the pump can be halved, for example, if the rotational speed of the die roll is the same as the conventional speed), so that a mechanical load or burden applied to the apparatus can be reduced. As a result, the apparatus can be prevented from troubling in advance, and the apparatus can be used for a long period of time to assure the long life of the apparatus.

5. Still further, in a case where the driving speed of the plunger type pump is halved so the rotational speed of the die roll is the same as the conventional one, the apparatus can cope with a filling material (having a high viscosity) which has been heretofore not filled because of high resistance at the sliding parts of the conventional pump and nozzle holes of the conventional nozzle segment.

6. Finally, the invention can be worked in a state where a standard size of the die roll or the size of the nozzle segment is fundamentally the same as the conventional one and a slight change is made in the nozzle segment, namely, the nozzle holes are provided in two rows. Further, if the invention employs the plunger type pump, the distributor and the slide valve mechanism, the invention has an advantage that it can cope with such employment by a partial exchange therebetween.

What is claimed is:

1. A method of manufacturing soft capsules in a soft capsule manufacturing apparatus comprising first and second die rolls that are close to and confront each other, each of the die rolls having capsule pockets in a plurality of rows, a nozzle segment having a tapering downward projection with first and second curved faces that are positioned at opposing sides of a lower end central portion of the nozzle segment, each of said curved faces having a plurality of rows each having a plurality of nozzle apertures, wherein the first curved face of the nozzle segment is positioned adjacent an upper portion of the first die roll and the second curved face of the nozzle segment is positioned adjacent an upper portion of the second die roll, the plurality of rows of the nozzle apertures in the first and second curved faces corresponding to the capsule pockets formed in the first and second die rolls, the method comprising the steps of:

feeding gelatin sheets between the first die roll and the first curved face and also between the second die roll and the second curved face of the nozzle segment and into contact with each other at a nip located at a narrowest part between the first and second die rolls;

applying filling material simultaneously through all of the plurality of nozzle apertures of all of the plurality of rows on the first and second curved faces onto the gelatin sheets overlying the die rolls at positions having the capsule pockets; and cutting the gelatin sheets about the capsule pockets to form soft capsules.

2. The method of manufacturing soft capsules of claim 1, wherein applying filling material to a plurality of rows of the capsule pockets through the plurality of rows of the nozzle apertures enables the die rolls to rotate at a speed at least twice the speed of die rolls receiving filling material applied at the same speed by a single row having a plurality of the nozzle apertures.

3. The method of manufacturing soft capsules of claim 1, wherein the step of applying the filling material to the capsule pockets includes driving the filling material through the plurality of rows of the nozzle apertures during each stroke of a pump.

4. A soft capsule manufacturing apparatus comprising:

a pair of die rolls that are positioned so as to have a nip therebetween, each of said die rolls having a plurality of rows each having a plurality of capsule pockets therein;

a nozzle segment for supplying a filling material and having opposing curved faces opening downwardly from a lower end portion of the nozzle segment projecting toward the nip between the die rolls, each of the curved faces of the nozzle segment receiving and confronting a portion of a respective one of the pair of die rolls, said curved faces each having a plurality of substantially parallel rows spaced in a feed direction, each said row having a plurality of spaced nozzle apertures for supplying a filling material, and the apertures of a first said row are non-aligned in the feed direction with the apertures of an adjacent second said row as provided on each said curved face; and means for advancing gelatin sheets between the respective curved faces of the nozzle segment and the respective die rolls in the feed direction to enable passageways in said nozzle segment to transfer filling material from a source to the plurality of rows of the nozzle apertures to apply the filling material to capsules formed in the gelatin sheets at the nip.

5. The soft capsule manufacturing apparatus of claim 4, including a pump for driving the filling material through the plurality of rows of the nozzle apertures to fill the capsule pockets during each stroke of the pump.

* * * * *